United States Patent [19]

Otsuka et al.

[11] Patent Number: 4,556,419

[45] Date of Patent: Dec. 3, 1985

[54] PROCESS FOR TREATING MOLTEN ALUMINUM TO REMOVE HYDROGEN GAS AND NON-METALLIC INCLUSIONS THEREFROM

[75] Inventors: Ryotatsu Otsuka, Osaka; Sigemi Tanimoto; Kazuo Toyoda, both of Izumi, all of Japan

[73] Assignee: Showa Aluminum Corporation, Sakai, Japan

[21] Appl. No.: 663,056

[22] Filed: Oct. 19, 1984

[30] Foreign Application Priority Data

Oct. 21, 1983 [JP] Japan ..... 58-197848
Oct. 21, 1983 [JP] Japan ..... 58-197847

[51] Int. Cl.[4] ..... C22B 21/06
[52] U.S. Cl. ..... 75/68 R; 75/93 E
[58] Field of Search ..... 75/68 R, 93 E

[56] References Cited

U.S. PATENT DOCUMENTS 2,654,670 10/1953 Davis et al. ..... 75/68 R
3,955,970 5/1976 Claxton et al. ..... 75/68 R
4,392,888 7/1983 Eckert et al. ..... 75/68 R

FOREIGN PATENT DOCUMENTS 72143 6/1981 Japan ..... 75/68 R

*Primary Examiner*—Melvyn J. Andrews

[57] ABSTRACT

Hydrogen gas and non-metallic inclusions are removed from molten aluminum by a process comprising the steps of maintaining an atmosphere containing $BF_3$ gas in a treating vessel above the surface of molten aluminum placed therein, introducing a treating gas into the molten aluminum, and removing floating non-metallic inclusions and treating gas containing hydrogen gas from the surface of the molten aluminum.

8 Claims, 6 Drawing Figures

PROCESS FOR TREATING MOLTEN ALUMINUM TO REMOVE HYDROGEN GAS AND NON-METALLIC INCLUSIONS THEREFROM

BACKGROUND OF THE INVENTION

The present invention relates to a process for treating molten aluminum to remove hydrogen gas and non-metallic inclusions from the melt.

The term "aluminum" as used herein and in the appended claims includes pure aluminum and all aluminum alloys. Further the term "inert gas" used includes argon gas, helium gas, krypton gas and xenon gas on the Periodic Table and nitrogen gas which is inert to aluminum.

Molten aluminum before casting contains dissolved hydrogen gas and non-metallic inclusions, such as oxides of aluminum and magnesium, as undesirable impurities. Hydrogen gas and non-metallic inclusions, when present in molten aluminum, could produce defects in the ingots prepared from the melt and also in the products prepared from the ingot. Accordingly hydrogen gas and non-metallic inclusions must be removed from the molten metal.

Hydrogen gas and non-metallic inclusions are removed from molten aluminum usually by introducing an inert gas or chlorine gas into the molten metal in the form of bubbles. However, since the atmosphere contains water (in an amount of up to about 30 mg/liter in summer or up to about 5 mg/liter in winter in Osaka, Japan), aluminum and the water in the atmosphere react on the surface of the molten metal ($2Al+3H_2O \rightarrow Al_2O_3+3H_2$), giving rise to the problem that the resulting hydrogen penetrates into the melt. The surface of molten aluminum which is allowed to stand is usually covered with a compact aluminum oxide coating, so that the water in the atmosphere will not react with aluminum. Nevertheless, when a treating gas, such as an intert gas or chlorine gas, is forced into molten aluminum, the bubbles released to float on the surface of the melt disturb the surface and break the aluminum oxide coating over the melt surface, exposing the melt to the atmosphere at the broken portion. The water in the atmosphere then reacts with aluminum before a fresh oxide coating is formed at the broken portion, producing hydrogen gas and permitting the gas to penetrate into the melt.

Accordingly another process has been proposed in which a treating vessel of closed construction is used for containing molten aluminum (U.S. Pat. No. 3,870,511). With this process, an inert gas is filled into the vessel above the surface of the molten aluminum placed therein, and a treating gas is introduced into the melt while maintaining the gas atmosphere at a pressure higher than atmospheric pressure. This process, however, requires an expensive apparatus for holding the treating vessel closed. Further even if having a closed structure, the vessel inevitably permits ingress of some atmospheric air through the inlet for the molten metal or through a small clearance between the lid and the vessel main body. Our experiments have revealed that even when the water content of the atmosphere above the molten aluminum surface increases to as small a value as about 0.5 mg/liter owing to the ingress of air, the hydrogen resulting from the reaction between the water and the molten aluminum penetrates into the melt. The process therefore fails to achieve a satisfactory effect to remove hydrogen gas.

Furthermore, it is difficult for the conventional process to effectively remove hydrogen gas from a melt of aluminum having a high purity of not lower than 99.9 wt. %.

SUMMARY OF THE INVENTION

An object of the present invention is to provide a process for removing hydrogen gas and non-metallic inclusions from molten aluminum by introducing a treating gas into the molten aluminum wherein the reaction between aluminum and the water in the atmosphere above the surface of the molten aluminum is inhibited to achieve an improved hydrogen gas removal efficiency.

Another object of the invention is to provide a process which does not involve the necessity of using a treating vessel of closed construction for containing molten aluminum and which can be practiced by an inexpensive apparatus.

The process of this invention for treating molten aluminum to remove hydrogen gas and non-metallic inclusions therefrom comprises the steps of maintaining an atmosphere containing $BF_3$ gas in a treating vessel above the surface of molten aluminum placed therein, introducing a treating gas into the molten aluminum, and removing floating non-metallic inclusions and treating gas containing hydrogen gas from the surface of the melt.

According to this process, even if water is present in the internal atmosphere of the vessel above the surface of molten aluminum therein, the reaction between the water and aluminum is greatly inhibited to achieve an improved hydrogen removal efficiency. Moreover, the invention can be practiced without necessitating an expensive apparatus which is needed for the treating vessel of closed construction.

The atmosphere within the treating vessel above the surface of molten aluminum therein can be replaced by an atomosphere containing $BF_3$ gas and the $BF_3$-containing atmosphere can be maintained, for example, by supplying $BF_3$ gas produced outside the treating vessel to the vessel, or by applying a borofluoride over the surface of the molten aluminum and causing the heat of the melt to decompose the borofluoride to produce $BF_3$ gas. When the $BF_3$ gas is supplied to the treating vessel from outside, the gas is supplied continuously or intermittently during the treatment, or the gas is supplied before the start of the treatment in such an amount that the $BF_3$-containing atmosphere can be maintained until the treatment is completed. When the $BF_3$ gas is produced within the vessel, the borofluoride is applied to the surface of the melt in such an amount that the $BF_3$-containing atmosphere can be maintained until the treatment is completed, or the salt is applied in small portions at a predetermined time interval.

The presence of $BF_3$ gas in the internal atmosphere of the treating vessel remarkably inhibits the reaction between aluminum and the water in the atmosphere. The mechanism, although not apparent, will presumably is as follows. $BF_3$ and aluminum undergo the following reaction to produce boron.

$$BF_3+Al \rightarrow B+AlF_3$$

The boron then reacts with the oxygen in the atmosphere as follows, giving boron oxide.

$$4B+3O_2 \rightarrow 2B_2O_3$$

It appears that this boron oxide contributes to the inhibition of the reaction between the aluminum and the water in the atmosphere.

Useful treating gases which are to be introduced into molten aluminum are various gases, such as inert gases and chlorine gas, which are usually used for removing hydrogen gas and non-metallic inclusions from molten metals.

The hydrogen within the molten aluminum diffuses through the bubbles of treating gas and is entrained therein when these bubbles move upward through the melt to the surface thereof, whereupon the hydrogen gas is released to the atmosphere. The non-metallic inclusions in the molten aluminum are carried to the dross layer over the surface of the molten metal by the bubbles of treating gas. The hydrogen-containing treating gas released into the atmosphere and the dross containing the non-metallic inclusions on the melt surface are removed by a suitable known method. The process of the invention is almost comparable to the conventional process in the efficiency to remove the non-metallic inclusions.

When treating molten aluminum, it is desirable to apply over the surface of the melt a halide (chloride, fluoride or the like) of at least one metal selected from the group consisting of alkali metals and alkaline earth metals. This improves the effect to be produced by the $BF_3$-containing atmosphere maintained above the surface of molten aluminum although the reason therefor has not been clarified.

The present process removes hydrogen gas from molten high-purity aluminum more efficiently than heretofore possible.

The invention will be described in greater detail with reference to the accompanying drawings.

DESCRIPTION OF THE PREFERRED EMBODIMENTS

Figure 1:
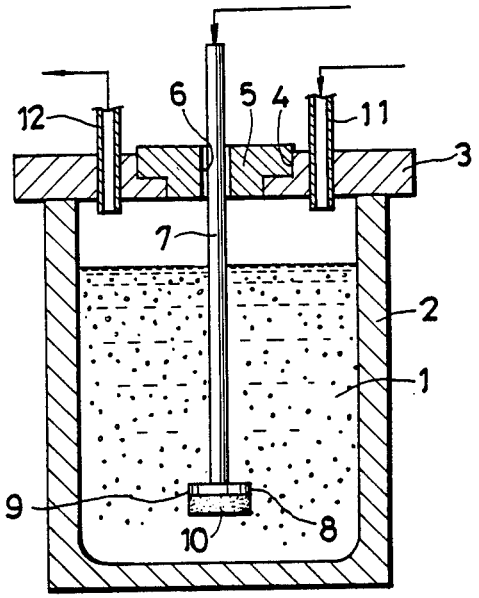
FIG. 1 is a view in vertical section showing a first embodiment of apparatus for use in practicing the process of the invention for treating molten aluminum.
Figure 2:
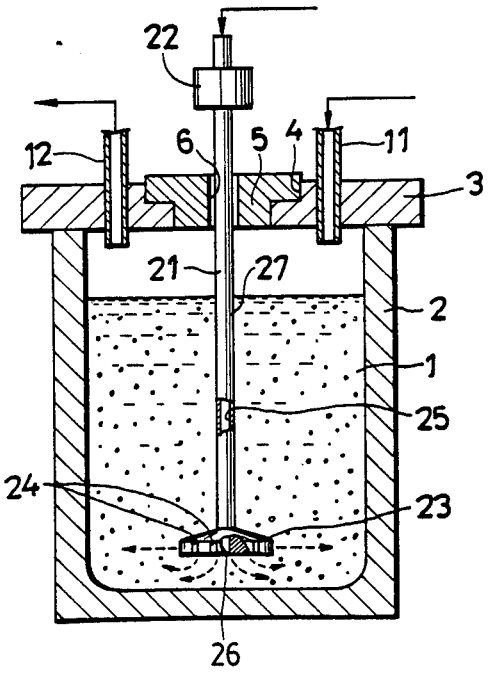
FIG. 2 is a view in vertical section showing a second embodiment of apparatus for use in practicing the process of the invention.
Figure 3:
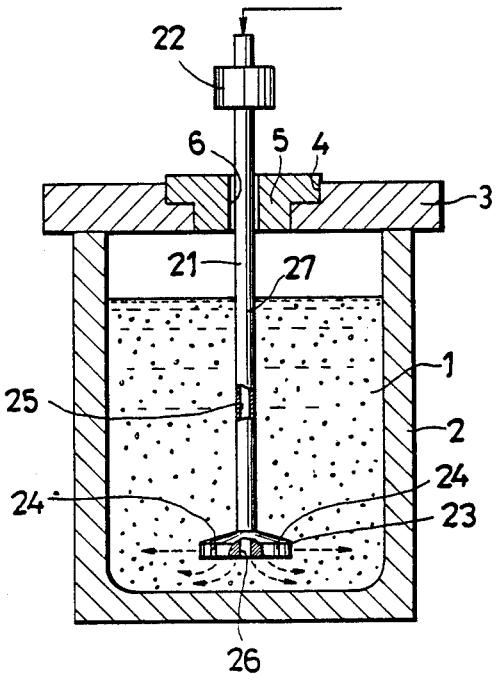
FIG. 3 is a view in vertical section showing a third embodiment of apparatus for practicing the process of the invention.

Throughout FIGS. 1 to 3, like parts are referred to by like reference numerals.

With reference to FIG. 1 showing a first embodiment for use in treating molten aluminum according to the invention, the molten aluminum 1 to be treated and containing hydrogen gas and non-metallic inclusions is placed in a treating vessel 2 to a level slightly below the upper end of the vessel 2. The vessel 2 has an upper-end opening which is closed with a lid 3. The lid 3 is centrally formed with a hole 4, which is closed with a removable plug 5. The hole 4 is so sized as to permit the release member 8 to be described later to pass therethrough. The plug 5 has a central bore 6, through which a treating gas supply pipe 7 is inserted. Thus, the pipe 7 extends through the lid 3. The upper end of the pipe 7 is connected to an unillustrated treating gas supply device. The lower end of the pipe 7 extends to a location close to the bottom of the vessel 2 and is provided with a member 8 for releasing a treating gas in the form of bubbles. The release member 8 comprises a disk-like main body 9 and a ceramic porous body 10 attached to the bottom of the main body 9. The main body 9 is centrally formed with a treating gas channel (not shown) vertically extending therethrough. The upper end of the channel is in communication with the interior of the supply pipe 7. At the right side of the hole 4, a $BF_3$ gas supply pipe 11 fixedly extends through the lid 3. The supply pipe 11 is connected to an unillustrated $BF_3$ gas supply device. At the left side of the hole 4, a vent pipe 12 is fixedly inserted through the lid 3. The vent pipe 12 is connected to a device (not shown) for treating a gas of fluorine-containing compound which device is provided for controlling air pollution. The vent pipe 12 is not always needed; the gas within the vessel 2 may be sent to the treating device after the treatment for removing hydrogen gas and non-metallic inclusions. The lower ends of the supply pipe 11 and the vent pipe 12 are positioned above the surface of the molten aluminum 1.

With the apparatus described, $BF_3$ gas is supplied from the $BF_3$ gas supply device through the pipe 11 to the interior space of the treating vessel 2 above the molten aluminum 1 therein to form an atmosphere containing $BF_3$ gas. It is desirable for this atmosphere to have a $BF_3$ concentration of at least 2 vol. % because if the concentration is less than 2 vol. %, the effect to be produced by $BF_3$ will not always be fully available. It is more desirable that the concentration be at least 10 vol. %. On the other hand, even if the $BF_3$ concentration of the atmosphere exceeds a certain level, the effect of $BF_3$ levels off, while use of an excessive amount is uneconomical. Further the excess of $BF_3$ which is toxic poses a problem in treatment. Accordingly the upper limit for the $BF_3$ concentration is preferably about 40 vol. %. After the atmosphere above the surface of the molten aluminum 1 has been replaced by the $BF_3$-containing atmosphere, a treating gas is introduced into the melt 1 by supplying the gas from the treating gas supply device via the pipe 7. The gas is passed through the channel and then through the pores of the porous body 10 and released into the melt 1 in the form of fine bubbles.

Before the treating gas is introduced into the molten aluminum 1, it is desirable to apply to the surface of the melt 1 a halide (chloride, fluoride or the like) of at least one metal selected from the group consisting of alkali metals and alkaline earth metals. In this case, the halide is used preferably in an amount of at least 0.003 $g/cm^2$, more preferably at least 0.006 $g/cm^2$, based on the surface area of the melt 1.

FIG. 2 shows a second embodiment of apparatus for use in practicing the process of the invention for treating molten aluminum. With reference to this drawing, a rotatable rotary shaft 21 is inserted through a bore 6 formed in a plug 5 centrally therethrough. The shaft 21 is rotatable by a motor 22. A treating gas supply channel 25 extends through the rotary shaft longitudinally thereof. The channel 25 has an upper end communicating with an unillustrated treating gas supply device. The rotary shaft 21 has a lower end extending to a location close to the bottom of the treating vessel 2 and fixedly provided with a rotor 23. A treating gas outlet 26 communicating at its upper end with the channel 25 is formed in the center of the bottom of the rotor 23. The peripheral surface of the rotor 23 is formed with a plurality of vertical grooves 24 arranged at a specified spacing circumferentially thereof. The upper end of each vertical groove 24 is open at the upper surface of the rotor 23, and the lower end thereof at the lower surface. The rotary shaft 21 and the rotor 23 constitute a treating gas injector 27.

With the apparatus described, the atmosphere within the treating vessel 2 above the surface of molten aluminum 1 placed therein is converted to an atmosphere containing $BF_4$ gas in the same manner as in the case of FIG. 1. For the same reason as already stated, the atmosphere has a $BF_3$ concentration of at least 2 vol. %, preferably at least 10 vol. %. After the atmosphere above the surface of the molten aluminum 1 has been converted to the $BF_3$-containing atmosphere, a treating gas is forced into the molten aluminum 1 from the outlet 26 while the rotary shaft 21 is being rotated by the motor 22 to rotate the rotor 23. The gas is supplied from the treating gas supply device to the outlet 26 through the channel 25. The gas is supplied further from the lower-end opening of the outlet 26 to the bottom of the rotor 23. By the centrifugal force resulting from the rotation of the rotor 23 and the action of the vertical grooves 24, the treating gas is released in the form of fine bubbles from the periphery of the rotor 23 so as to diffuse through the entire mass of the molten aluminum 1.

In the case of the apparatus shown in FIG. 2, as in the case of the one shown in FIG. 1, it is desirable to apply to the surface of the molten aluminum 1 a halide (chloride, fluoride or the like) of at least one metal selected from the group consisting of alkali metals and alkaline earth metals in an amount of at least 0.003 g/cm$^2$, preferably at least 0.006 g/cm$^2$, based on the surface area of the melt, before the treating gas is introduced into the melt.

With reference to FIG. 3 showing a third embodiment of apparatus for use in practicing the process of the invention for treating molten aluminum, the apparatus differs from the one shown in FIG. 2 in that the $BF_3$ gas supply pipe and the vent pipe are not attached to the lid 3.

With this apparatus, a borofluoride, such as $NaBF_4$, $KBF_4$, $LiBF_4$ or $NH_4BF_4$, is applied to the surface of molten aluminum 1. The borofluoride applied is decomposed by the heat of the molten aluminum 1 to produce $BF_3$ gas, which forms a $BF_3$-containing atmosphere above the surface of the melt 1. The borofluoride is used in such an amount that the atmosphere above the surface of the melt 1 has a $BF_3$ concentration of at least 2 vol. %, preferably at least 10 vol. %.

After the atmosphere above the surface of the molten aluminum 1 has been converted to the $BF_3$-containing atmosphere, a treating gas is introduced into the molten aluminum 1 from the outlet 26 while the rotary shaft 21 is being rotated about its axis by the motor 22 to rotate the rotor 23. For the introduction of the treating gas, the gas is supplied from a supply device therefor via the treating gas supply channel 25. As is the case with the apparatus of FIG. 2, the treating gas is released in the form of bubbles so as to diffuse through the entire mass of the molten aluminum.

With the apparatus of FIG. 3, as is the case with those shown in FIGS. 1 and 2, it is desirable to apply to the surface of the molten aluminum 1 a halide (chloride, fluoride or the like) of at least one metal selected from the group consisting of alkali metals and alkaline earth metals in an amount of at least 0.003 g/cm$^2$, preferably at least 0.006 g/cm$^2$, based on the surface area of the melt, before the treating gas is introduced into the melt.

EXAMPLE 1

Figure 4:
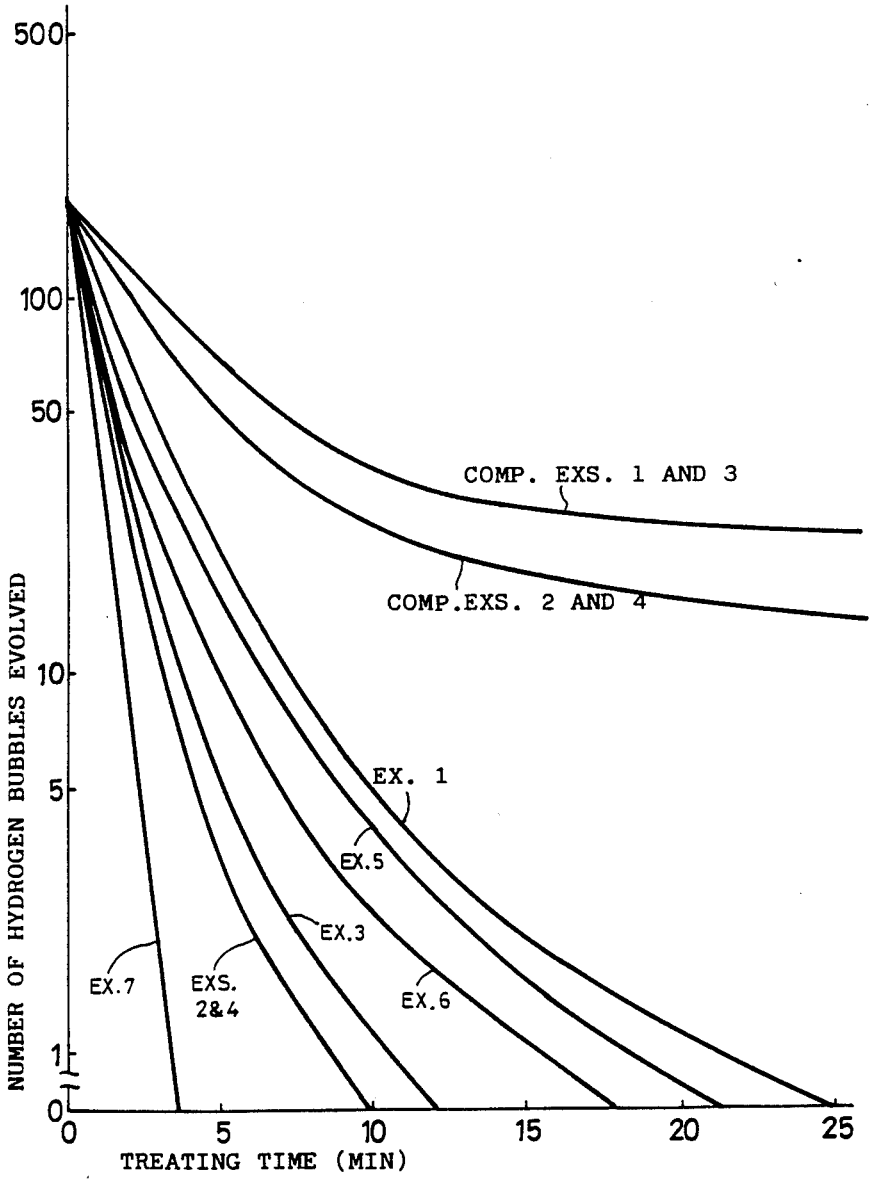
FIG. 4 is a graph showing the results achieved by Examples 1 to 7 and Comparison Examples 1 to 4 to illustrate the relationship between the hydrogen gas removal treating time and the number of hydrogen bubbles evolved when the treated melt is solidified in a vacuum.

The apparatus shown in FIG. 1 was used for this example. A 500 kg quantity of molten aluminum A1100 was placed into the treating vessel 2 and maintained at 700 to 730° C. The interior space of the vessel 2 above the surface of the melt 1 had a volume of 74 liters. The atmosphere in this space contained 20 mg/liter of water. $BF_3$ gas (8 liters) was supplied from the supply device therefor to the vessel 2 via the supply pipe 11 to convert the atmosphere above the surface of the melt 1 to a $BF_3$-containing atmosphere, which was found to have a $BF_3$ concentration of 10 vol. %. Ar gas was thereafter introduced into the molten aluminum 1 at a rate of 20 liters/min from the treating gas supply device via the supply pipe 7. To determine the efficiency to remove hydrogen gas from the melt 1, 200 g of the melt 1 was then collected in a red-hot iron container and solidified in a vacuum of 2 torr. The number of hydrogen bubbles evolved until the melt was completely solified was measured. FIG. 4 shows the relationship thus established between the hydrogen gas removal treating time and the number of hydrogen bubbles evolved when the treated melt was solidified.

EXAMPLE 2

The relationship was determined between the hydrogen gas removal treating time and the number of hydrogen bubbles evolved when treated melt was solidified, under the same conditions and by the same method as in Example 1 except that A5052 (containing 2.5 wt. % of Mg) was used as the melt 1 in place of A1100. FIG. 4 shows the result.

EXAMPLE 3

The relationship was determined between the hydrogen gas removal treating time and the number of hydrogen bubbles evolved when treated melt was solidified, under the same conditions and by the same method as in Example 1 except that A6063 (containing 0.7 wt. % of Mg) was used as the melt 1 in place of A1100. FIG. 4 shows the result.

EXAMPLE 4

The relationship was determined between the hydrogen gas removal treating time and the number of hydrogen bubbles evolved when treated melt was solidified, under the same conditions and by the same method as in Example 1 except that A7N01 (containing 1.5 wt. % of Mg) was used as the melt 1 in place of A1100. FIG. 4 shows the result.

EXAMPLE 5

The relationship was determined between the hydrogen gas removal treating time and the number of hydrogen bubbles evolved when treated melt was solidified, under the same conditions and by the same method as in Example 1 except that the interior atmosphere of the vessel 2 above the surface of the melt 1 had a $BF_3$ concentration of 20 vol. % before Ar gas was introduced into the melt 1. FIG. 4 shows the result.

EXAMPLE 6

The relationship was determined between the hydrogen gas removal treating time and the number of hydrogen bubbles evolved when treated melt was solidified, under the same conditions and by the same method as in Example 1 except that the atmosphere within the vessel 2 above the surface of the melt 1 had a $BF_3$ concentration of 40 vol. % before Ar gas was introduced into the melt 1. FIG. 4 shows the result.

EXAMPLE 7

The apparatus shown in FIG. 2 was used for this example. This example is the same as Example 1 in respect of the kind (A1100) and amount (500 kg) of the melt 1, the melt maintaining temperature (700° to 730° C.), the volume (74 liters) of the interior space of the treating vessel 2 above the surface of the melt 1 therein, the water content (20 mg/liter) of the atmosphere above the melt surface, the method of converting the atmosphere above the melt surface to a $BF_3$-containing atmosphere, the $BF_3$ concentration (10 vol. %) of this atmosphere before the introduction of Ar gas and the conditions for counting the number of hydrogen bubbles evolved when the treated melt 1 was solidified. While rotating the rotary shaft 21 at 650 r.p.m., Ar gas was introduced into the melt 1 at a rate of 20 liters/min from the treating gas supply device via the supply channel 25 and the outlet 26. FIG. 4 shows the relationship thus determined between the hydrogen gas removal treating time and the number of hydrogen bubbles evolved when the treated melt was solidified.

EXAMPLE 8

Figure 5:
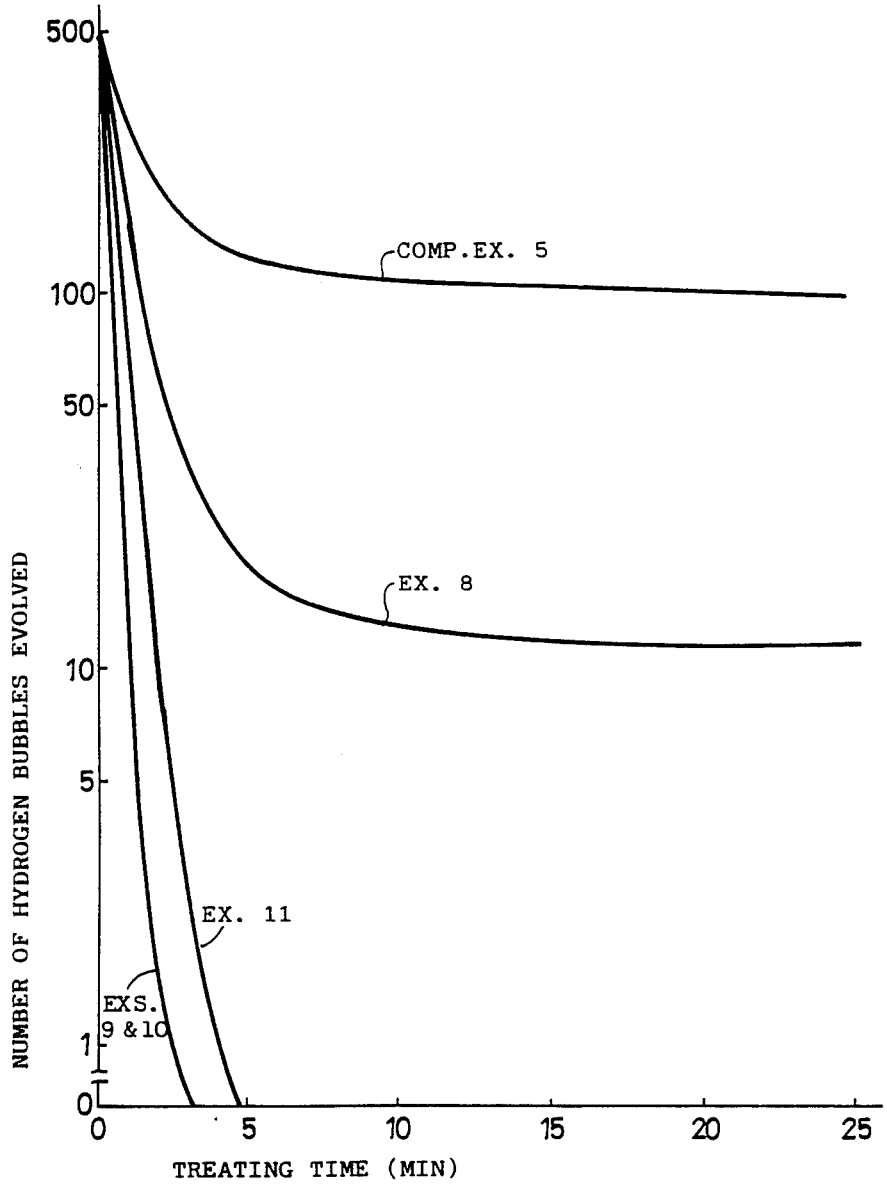
FIG. 5 is a graph showing the results achieved by Examples 8 to 11 and Comparison Example 5 to illustrate like relationship.

The relationship was determined between the hydrogen gas removal treating time and the number of hydrogen bubbles evolved when treated melt was solidified, under the same conditions and by the same method as in Example 7 except that aluminum having a purity of at least 99.99 wt. % was used as the melt 1 in place of A1100 and that the atmosphere within the vessel 2 above the surface of the melt 1 therein had a water content of 25 mg/liter. FIG. 5 shows the result.

EXAMPLE 9

The relationship was determined between the hydrogen gas removal treating time and the number of hydrogen bubbles evolved when treated melt was solidified, under the same conditions and by the same method as in Example 8 except that NaF was applied to the surface of the melt in an amount of 0.01 g/cm$^2$ based on the surface area of the melt, before the introduction of the treating gas. FIG. 5 shows the result.

EXAMPLE 10

The relationship was determined between the hydrogen gas removal treating time and the number of hydrogen bubbles evolved when treated melt was solidified, under the same conditions and by the same method as in Example 9 except that the halide applied to the surface of the melt 1 was KCl, which was used in an amount of 0.01 g/cm$^2$ based on the surface area of the melt 1. FIG. 5 shows the result.

EXAMPLE 11

The relationship was determined between the hydrogen gas removal treating time and the number of hydrogen bubbles evolved when treated melt was solidified, under the same conditions and by the same method as in Example 9 except that the halide applied to the surface of the melt 1 was $MgF_2$, which was used in an amount of 0.02 g/cm$^2$ based on the surface area of the melt 1. FIG. 5 shows the result.

EXAMPLE 12

Figure 6:
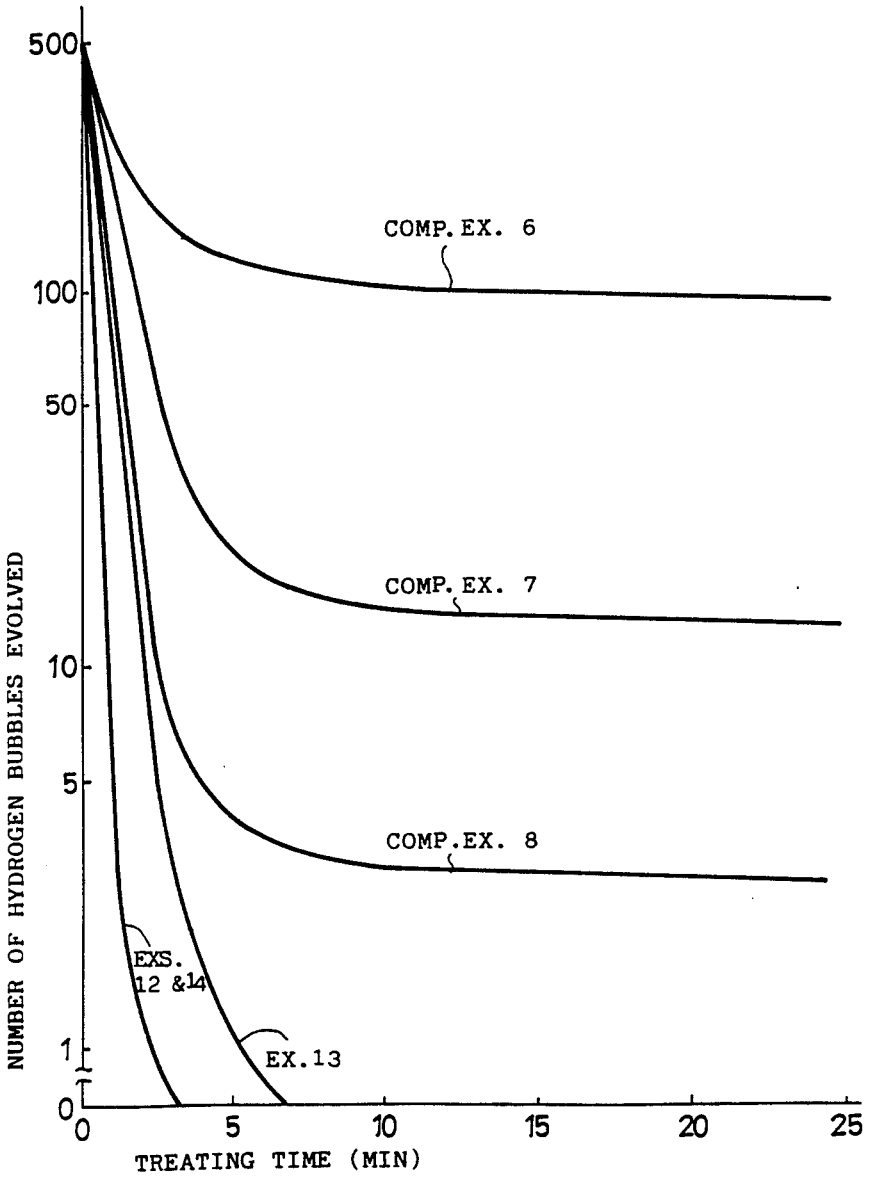
FIG. 6 is a graph showing the results achieved by Examples 12 to 14 and Comparison Examples 6 to 8 to illustrate like relationship.

The apparatus shown in FIG. 3 was used for this example. A 500 kg quantity of molten aluminum 1 having a purity of 99.99 wt. % was placed into the treating vessel 2 and maintained at 700° to 730° C. The interior space of the vessel 2 above the surface of the melt 1 had a volume of 74 liters. The atmosphere above the surface of the melt 1 was found to contain 25 mg/liter of water. $NaBF_4$ (100 g) was then applied to the entire surface of the melt 1. While rotating the rotary shaft 21 at 650 r.p.m., Ar gas was then introduced into the melt 1 at a rate of 20 liters/min from the treating gas supply device via the supply channel 25 and the outlet 26. Under the same conditions and by the same method as in Example 1, the relationship was determined between the hydrogen gas removal treating time and the number of hydrogen bubbles evolved when the treated melt was solidified. FIG. 6 shows the result. The atmosphere above the surface of the melt 1 had a $BF_3$ concentration of 30 vol. %.

EXAMPLE 13

Under the same conditions and by the same method as in Example 12 except that 35 g of $NaBF_4$ was applied, the relationship was determined between the hydrogen gas removal treating time and the number of hydrogen bubbles evolved when treated melt was solidified. FIG. 6 shows the result. The atmosphere above the surface of the melt 1 had a $BF_3$ concentration of 10 vol. %.

EXAMPLE 14

Under the same conditions and by the same method as in Example 12 except that 120 g of $KBF_4$ was applied to the surface of the melt 1 in place of $NaBF_4$, the relationship was determined between the hydrogen gas removal treating time and the number of hydrogen bubbles evolved when treated melt was solidified. FIG. 6 shows the result. The atmosphere above the surface of the melt 1 had a $BF_3$ concentration of 30 vol. %.

COMPARISON EXAMPLE 1

The procedure of Example 1 was repeated under the same conditions as used therein except that the atmosphere within the vessel 2 was not converted to the $BF_3$-containing atmosphere. FIG. 4 shows the result.

COMPARISON EXAMPLE 2

The procedure of Example 2 was repeated under the same conditions as used therein except that the atmosphere within the vessel 2 above the melt surface was not converted to the $BF_3$-containing atmosphere. FIG. 4 shows the result.

COMPARISON EXAMPLE 3

The procedure of Example 3 was repeated under the same conditions as used therein except that the atmosphere within the vessel 2 above the melt surface was not converted to the $BF_3$-containing atmosphere. FIG. 4 shows the result.

COMPARISON EXAMPLE 4

The procedure of Example 4 was repeated under the same conditions as used therein except that the atmosphere within the vessel 2 above the melt surface was not changed to the $BF_3$-containing atmosphere. FIG. 4 shows the result.

COMPARISON EXAMPLE 5

The procedure of Example 8 was repeated under the same conditions as used therein except that the atmosphere within the vessel 2 above the melt surface was not changed to the $BF_3$-containing atmosphere. FIG. 5 shows the result.

COMPARISON EXAMPLE 6

The procedure of Example 12 was repeated under the same conditions as used therein except that the borofluoride was not applied to the surface of the melt 1. FIG. 6 shows the result.

COMPARISON EXAMPLE 7

The procedure of Example 12 was repeated under the same conditions as used therein with the exception of applying no borofluoride to the melt surface, introducing $N_2$ gas into the interior space of the vessel 2 above the melt surface at a rate of 20 liters/min to load the space with a pressure of 30 mm Aq and causing the atmosphere in this space to have a water content of 1 mg/liter. FIG. 6 shows the result.

COMPARISON EXAMPLE 8

The procedure of Example 12 was repeated under the same conditions as used therein with the exception of applying no borofluoride to the melt surface, introducing $N_2$ gas into the interior space of the vessel 2 above the melt surface at a rate of 50 liters/min to load the space with a pressure of 100 mm Hg and causing the atmosphere in this space to have a water content of 0.3 mg/liter. FIG. 6 shows the result.

The results of Examples 1 to 14 and Comparison Examples 1 to 8 reveal, for example, the following. (a) As will be apparent from all the examples and comparison examples, a higher hydrogen gas removal efficiency is achieved when a $BF_3$-containing atmosphere is formed above the melt surface in the treating vessel than when such an atmosphere is not provided (see Examples 1, 5 and 6). (b) A higher hydrogen gas removal efficiency is achieved when the molten metal to be treated contains Mg than when the metal contains no Mg (see Examples 1 to 4). (c) The apparatus of FIG. 2 is superior to the apparatus of FIG. 1 in hydrogen gas removal efficiency (see Examples 1 and 7). (d) The present process achieves a higher hydrogen gas removal efficiency when the treating vessel contains a $BF_3$-containing atmosphere above the melt surface and a halide of at least one metal selected from the group consisting of alkali metals and alkaline earth metals as applied to the melt surface than when the vessel contains such an atmosphere only with no halide applied to the melt surface (see Examples 8 to 11). (e) A higher hydrogen gas removal efficiency is achieved when the atmosphere above the melt surface within the vessel is a $BF_3$-containing atmosphere than when an inert gas such as $N_2$ is introduced into the atmosphere to make this atmosphere an inert gas atmosphere (see Examples 12 to 14 and Comparison Examples 6 to 8).

Other facts will be apparent to one skilled in the art from the results of Examples 1 to 14 and Comparison Examples 1 to 8.

What is claimed is:

1. A process for treating molten aluminum to remove hydrogen gas and non-metallic inclusions therefrom comprising the steps of maintaining an atmosphere containing $BF_3$ gas in a treating vessel above the surface of molten aluminum placed therein, introducing a treating gas into the molten aluminum, and removing floating non-metallic inclusions and treating gas containing hydrogen gas from the surface of the molten aluminum.

2. A process as defined in claim 1 wherein the atmosphere has a $BF_3$ gas concentration of at least 2 vol. %.

3. A process as defined in claim 1 wherein the atmosphere has a $BF_3$ gas concentration of at least 10 vol. %.

4. A process as defined in claim 1 wherein $BF_3$ gas is supplied from outside the treating vessel into the atmosphere within the treating vessel above the molten aluminum placed therein to convert the interior atmosphere to the atmosphere containing $BF_3$ gas.

5. A process as defined in claim 1 wherein a borofluoride is applied to the surface of the molten aluminum, and the borofluoride is decomposed by the heat of the molten aluminum to produce $BF_3$ gas, whereby the atmosphere containing $BF_3$ gas is formed and maintained as it is.

6. A process as defined in claim 1 further comprising the step of applying to the surface of the molten aluminum a halide of at least one metal selected from the group consisting of alkali metals and alkaline earth metals.

7. A process as defined in claim 6 wherein the halide is used in an amount of at least 0.003 $g/cm^2$ based on the surface area of the molten aluminum.

8. A process as defined in claim 1 wherein the treating gas is introduced into the molten aluminum by preparing a treating gas injector comprising a rotary shaft and a rotor fixed to the lower end of the rotary shaft, the rotary shaft being immersed in the molten aluminum and having an internal treating gas supply channel, the rotor having a treating gas outlet in communication with the gas supply channel, and rotating the rotor while supplying the treating gas to the gas supply channel to force out the treating gas from the gas outlet into the molten aluminum.

* * * * *